US006082681A

United States Patent [19]

Rand

[11] Patent Number: 6,082,681

[45] Date of Patent: Jul. 4, 2000

[54] BABY BOTTLE HOLDER

[76] Inventor: Jennifer Shields Rand, 6928 Budd St. NW., Olympia, Wash. 98503

[21] Appl. No.: 09/055,812

[22] Filed: Apr. 6, 1998

[51] Int. Cl.[7] ..... A47D 15/00; A47F 7/14

[52] U.S. Cl. ..... 248/102; 248/908

[58] Field of Search ..... 248/102, 103, 248/104, 105, 106, 908, 915

[56] References Cited

U.S. PATENT DOCUMENTS

| | | | |
|---|---|---|---|
| 159,197 | 1/1875 | Mason . | |
| 224,557 | 2/1880 | Potter . | |
| 227,075 | 4/1880 | Thompson . | |
| 234,224 | 11/1880 | Barton . | |
| 253,014 | 1/1882 | Day . | |
| 275,288 | 4/1883 | Thomas . | |
| 279,935 | 6/1883 | Glattsteine . | |
| 280,656 | 7/1883 | Morris . | |
| 593,830 | 11/1897 | Borgenschild . | |
| 1,859,123 | 5/1932 | Ballert | 248/105 |
| 2,050,622 | 8/1936 | Menk | 248/105 |
| 2,354,568 | 7/1944 | Allen | 248/105 |
| 2,451,718 | 10/1948 | Corrao | 248/105 |
| 2,499,930 | 3/1950 | Seiger . | |
| 2,522,647 | 9/1950 | Suich | 248/105 |
| 2,526,121 | 10/1950 | Curry et al. | 248/102 |
| 2,760,664 | 8/1956 | D'Amico et al. . | |
| 3,071,272 | 1/1963 | Doner . | |
| 3,905,571 | 9/1975 | Lombardo | 248/102 |
| 4,227,270 | 10/1980 | Rivera | 5/639 |
| 4,301,934 | 11/1981 | Forestal . | |
| 4,320,883 | 3/1982 | Bass . | |
| 4,895,327 | 1/1990 | Malone et al. | 248/102 |
| 4,898,290 | 2/1990 | Cueto . | |
| 4,944,418 | 7/1990 | Wallace . | |
| 5,072,843 | 12/1991 | James . | |
| 5,184,796 | 2/1993 | Maher | 248/104 |

*Primary Examiner*—Ramon O. Ramirez
*Assistant Examiner*—David Heisey
*Attorney, Agent, or Firm*—Christensen O'Connor Johnson & Kindness PLLC

[57] ABSTRACT

A baby bottle holder (10) for holding a baby bottle (93) within ready access of a feeding infant. The bottle holder includes a bottle support (12) that stably and securely holds a baby bottle, a cover (28) that encloses the bottle support and a strap (78) for securely attaching the baby bottle holder to a horizontal support member. The baby bottle holder retains a baby bottle at an angle that facilitates the flow of a liquid nutrient within the bottle towards an outlet defined by the bottle wall. The cover can be removable and washable, and is in the shape of an animate object, preferably a cow.

9 Claims, 4 Drawing Sheets

10
93
94
28
60
48
96
86
42
72
76
88
90
78
92
84
82
85

BABY BOTTLE HOLDER

FIELD OF THE INVENTION

The present invention relates to baby bottle holders, and especially to baby bottle holders including a light-weight block enclosed in a removable, washable cover in the form of an animal.

BACKGROUND OF THE INVENTION

In the first few months of life an infant lacks the ability to finely coordinate the movement of its limbs. In particular, a very young infant has not yet acquired sufficient manual dexterity to manipulate an infant's feeding bottle. If a predextrous infant is left to feed from a baby bottle without adult supervision, the infant frequently drops the bottle and is unable to retrieve the bottle and reinsert the nipple into its mouth. Even if the infant does not drop the bottle, the infant may be distracted and put the bottle aside for a period of time. When the infant wants to resume feeding it will again face the challenge of retrieving the bottle and reinserting the nipple into its mouth.

One solution to the problem of an infant's inability to dextrously manipulate its feeding bottle is to have an adult in constant attendance while the infant is feeding. This solution may be infeasible when, for example, the adult is supervising other children. Another solution to the problem of an infant's inability to dextrously manipulate its feeding bottle is to utilize a device that holds the bottle while the infant is feeding, i.e., a baby bottle holder. A number of problems must be addressed, however, when designing and constructing a baby bottle holder.

A baby bottle holder must be stably attached to a support surface in order to prevent an infant from inadvertently pushing the bottle holder out of reach, or causing the bottle holder to fall onto the infant's body. Although a baby bottle holder constructed from a dense, heavy material will be more difficult for an infant to dislodge, there is the inherent danger that if a heavy bottle holder falls onto an infant it will cause serious injury. Thus, a baby bottle holder should preferably be constructed from a lightweight material that is securely attached to a support structure located in the vicinity of a feeding infant. Ideally, a baby bottle holder should be securely attachable to a wide variety of structures, such as a baby's high chair or a baby's car seat. Additionally, the height of a baby bottle holder should be adjustable so that the bottle can be presented at the correct height to children of different sizes, or to the same child as it grows.

A baby bottle holder should support the bottle at an angle that permits the milk to flow to the nipple-end of the bottle under the force of gravity. Additionally, the angle of the bottle relative to a feeding infant should be adjustable to ensure that the nipple attached to the bottle is presented at the optimum angle to facilitate feeding.

Since an infant often spills milk, or other liquid nutrient, while feeding, a baby bottle holder should be constructed from a material, or covered with a material, that is washable. If a baby bottle holder is covered with a washable material, the cover can optionally be removable to facilitate cleaning.

Finally, a baby bottle holder should ideally present a pleasing and stimulating appearance to the infant, for example through the use of bright colors, toys attached to the holder or by designing the bottle holder itself in the form of an animal or other attractive and entertaining shape.

Further, although a baby bottle holder is especially adapted for use with a predextrous infant, a baby bottle holder can also be used with an older child that has acquired sufficient manual dexterity to manipulate a feeding bottle. In the case of the older child, tha baby bottle holder conveniently supports the baby bottle while permitting the child to direct its attention to its environment. In this way, the child does not inadvertently drop the bottle when distracted by some other event.

SUMMARY OF THE INVENTION

The present invention provides a baby bottle holder for holding a baby bottle within ready access of a feeding infant. The baby bottle holder includes a bottle support that stably and securely holds a baby bottle, a cover that encloses the bottle support and a strap for securely attaching the baby bottle holder to a substrate. The bottle holder retains a baby bottle at an angle that facilitates the flow of a liquid nutrient within the bottle towards an outlet defined by the bottle wall.

A first preferred embodiment of the present invention provides a foam block having an upper surface, a lower surface, a front face, a rear face, a first end and a second end. The upper surface slopes downwards from the rear face to the front face so that, when viewed from either the first end or the second end, the block has a trapezoidal cross-section with the two vertical sides being parallel, while the upper edge diverges from the lower edge. The block defines a groove that opens onto the central portion of the upper surface and the upper, central portion of the front face. The groove slopes downwards, at an angle of approximately 45° relative to a horizontal plane, from the distal portion of the upper surface towards the proximal portion of the upper surface. The groove is thus configured to receive a baby bottle at such an angle that the fluid contents of the bottle flow, under the force of gravity, towards an opening defined by the bottle wall. The block is completely enclosed in a removable, washable cover formed in the shape of an animate object, preferably an animal, most preferably a cow. The cover includes a pouch, for housing a baby bottle, that is seated within the groove. An inflatable bladder is attached to the lower surface of the cover. The baby bottle holder also includes a strap, bearing a buckle, that is attached to the lower surface of the bladder and extends beyond both the first end and the second end of the block.

In operation, the cover encloses the block and is secured thereon by means of a fastener, preferably a zipper. The pouch sewn into the cover is received within the groove defined by the block. A bottle is inserted into the pouch and retained therein mainly by the compressive resilience of the foam block. An adjustable strap is fixedly attached at one end to the portion of the cover that encloses the upper surface of the block. The strap extends across the upper aspect of the pouch-lined groove and is inserted into a loop attached to the cover. The strap can be tightened to help retain the bottle within the pouch-lined groove. Additionally, a retainer sewn into the front of the pouch prevents the bottle from sliding forward and out of the pouch. The baby bottle holder is securely attached to a supporting structure, such as the horizontal, table member of a baby's high chair, by wrapping the strap attached to the lower surface of the cover around the supporting structure and securing the ends of the strap by means of a buckle. The height of the baby bottle holder can be adjusted by inflating or deflating the bladder attached to the lower surface of the cover.

A second preferred embodiment of the baby bottle holder of the present invention is identical to the first preferred embodiment, except that a loop is formed in the portion of the strap, used to attach the baby bottle holder to a horizontal support surface, attached to the lower surface of the inflatable bladder. The strap loop receives a C-clamp which can be used to secure the baby bottle holder to a horizontal surface, such as the horizontal member of a table.

The present invention thus provides for a structurally stable, light-weight baby bottle holder that can be securely attached to a structure that supports an infant, or to a structure that is located close to a feeding infant. The baby bottle holder of the present invention holds a bottle at an angle that facilitates the flow of a nutrient liquid out of the bottle under the force of gravity, thereby aiding the feeding process. The soft, light-weight construction of the bottle holder of the present invention permits the bottle holder to rest on the child's body when the child is seated, for example, in a child's car seat. The angle and height of the bottle can be adjusted within the pouch-lined groove in order to ensure that the bottle is conveniently presented to the infant. Additionally, the bottle holder of the present invention preferably includes a bladder that can be completely or partially inflated or deflated in order to raise or lower the bottle relative to the infant. The baby bottle holder of the present invention is enclosed in a cover that is preferably removable and washable, thereby facilitating the process of removing spilled food and other waste material. The cover is also formed in the shape of an animate object, preferably an animal, and most preferably a cow, that presents a pleasing and entertaining appearance to the feeding child.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

The present invention provides a baby bottle holder that is lightweight and includes a removable, washable cover that is in the form of an animate object, such as a cow. The baby bottle holder includes an inflatable bladder for adjusting the height of the baby bottle holder, and a strap, attached to the lower surface of the bladder, for securely attaching the baby bottle holder to a horizontal, supporting structure.

Figure 1:
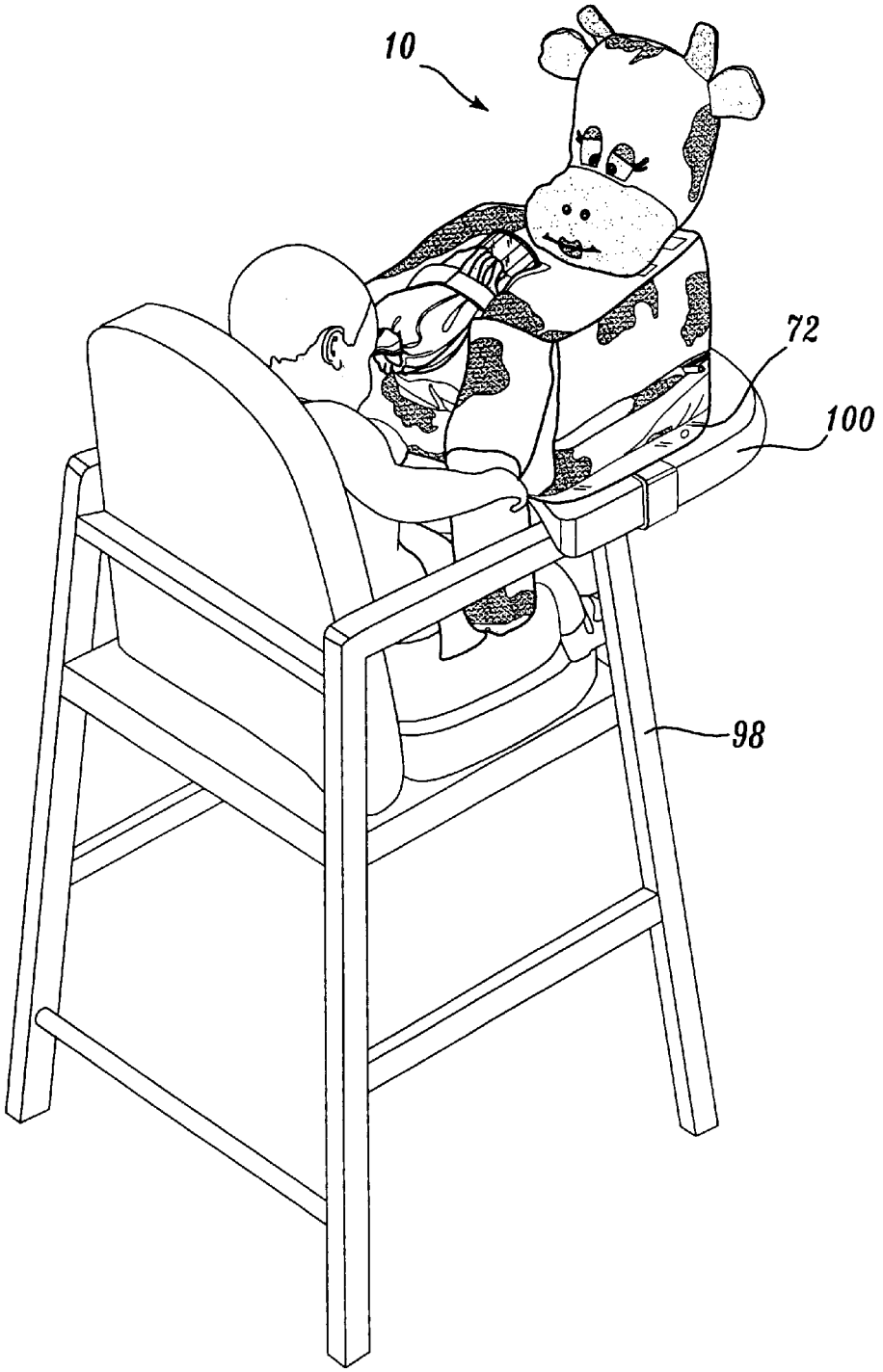
FIG. 1 is a three-dimensional, environmental view of the assembled, first preferred embodiment of the baby bottle holder of the present invention shown in relation to a feeding infant seated in a high chair.
Figure 2:
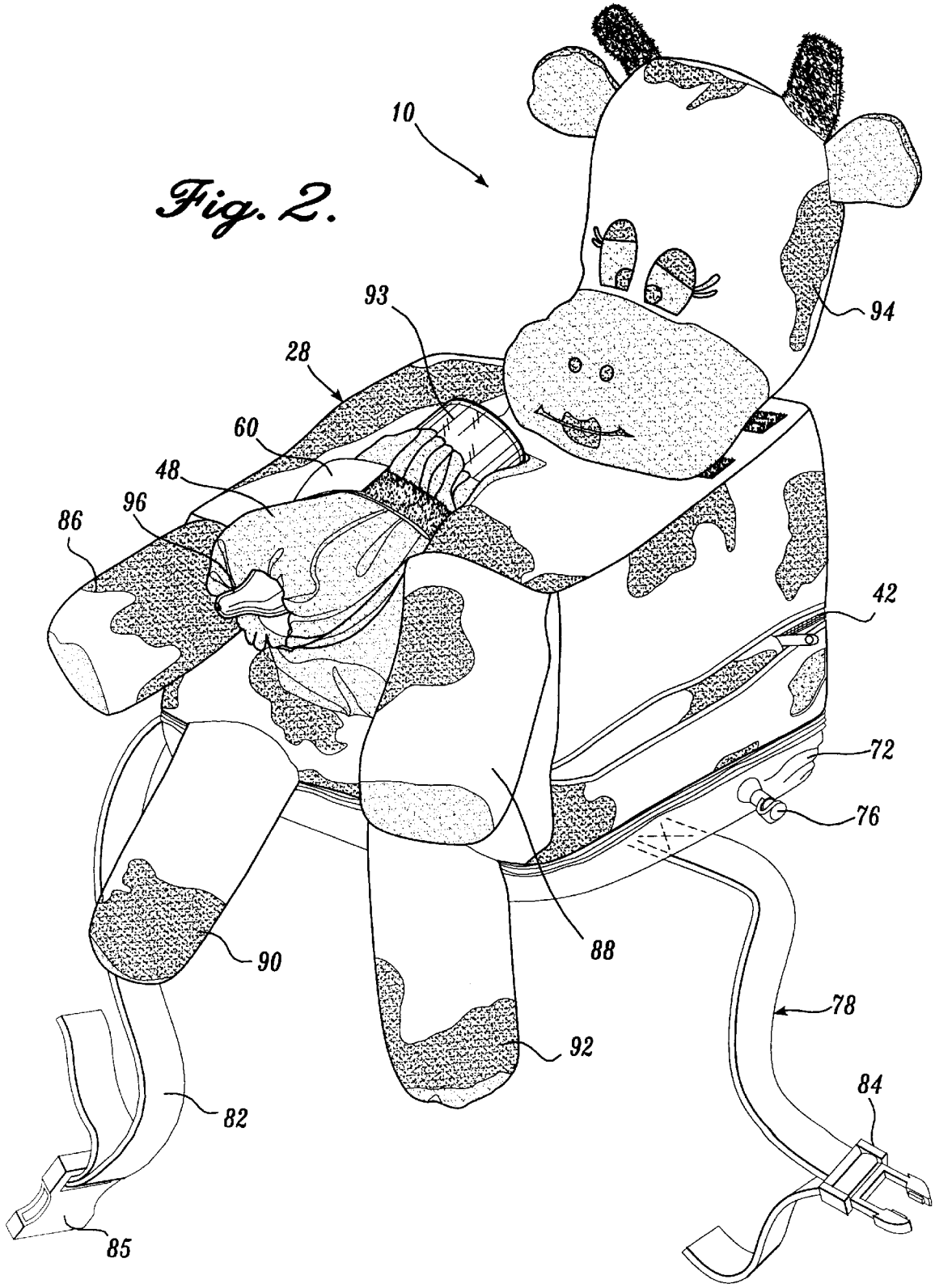
FIG. 2 is a three-dimensional view of the assembled, first preferred embodiment of the baby bottle holder of the present invention.
Figure 3:
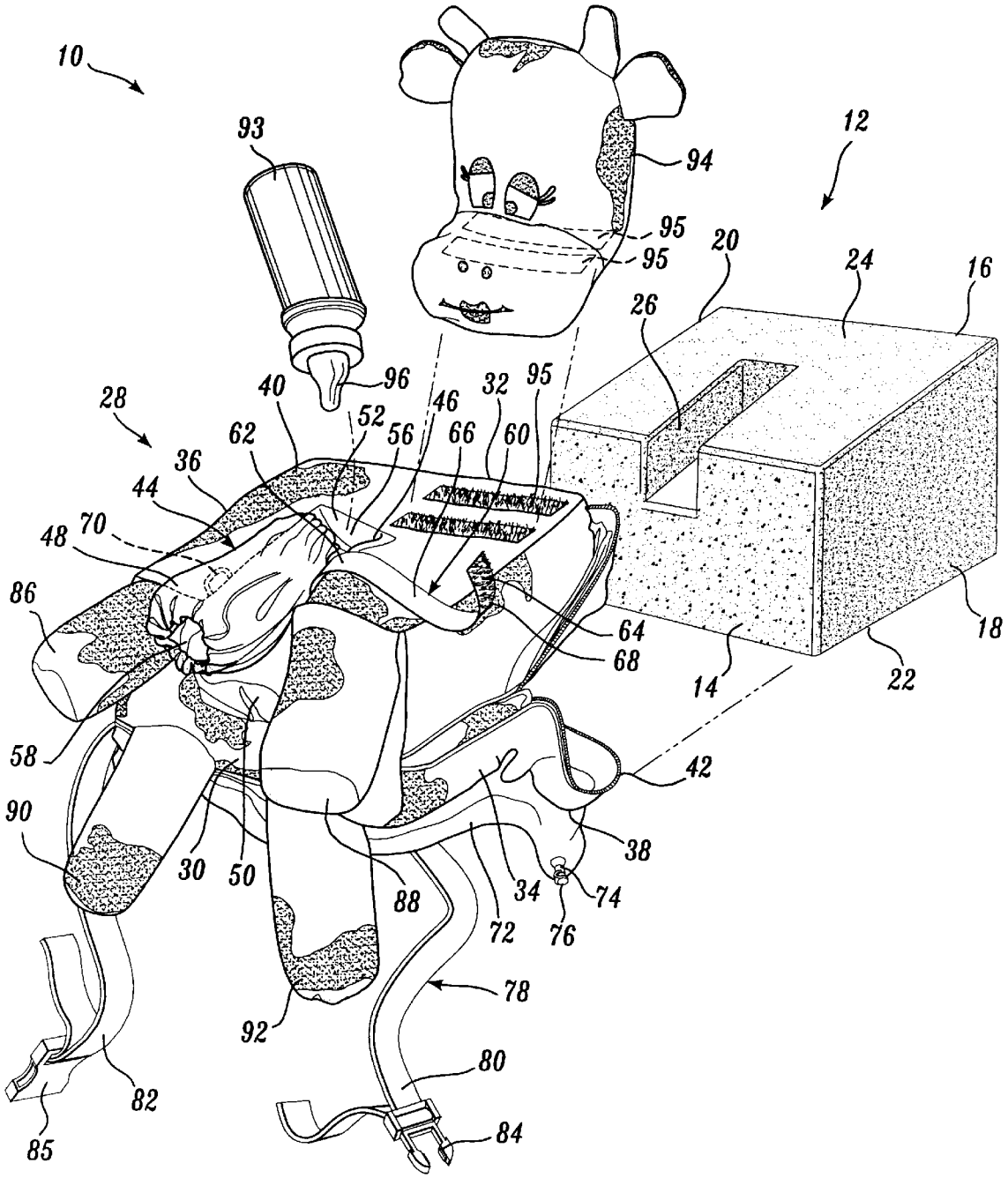
FIG. 3 is an exploded view of the first preferred embodiment of the baby bottle holder of the present invention, including a baby bottle.

With reference to FIGS. 1–3, and in particular to FIG. 3, the first preferred embodiment of the baby bottle holder 10 of the present invention includes a soft, foam block 12 having a front face 14, a rear face 16, a first end 18, a second end 20, a lower surface 22 and an upper surface 24. Block 12 has a generally cubical shape except that upper surface 24 slopes downwards from the upper edge of rear face 16 towards the upper edge of front face 14. Thus, when viewed from either first end 18 or from second end 20, block 12 has a trapezoidal cross-section with the two vertical sides being parallel, while the upper edge diverges from the lower edge. Block 12 defines a generally elongate, rectangular groove 26 that opens onto the central portion of upper surface 24 and onto the upper, central portion of front face 14. Groove 26 thus slopes downwards, at an angle of approximately 45° relative to a horizontal plane, from the distal portion, adjacent rear face 16, of upper surface 24 towards the proximal portion, adjacent front face 14, of upper surface 24.

Block 12 is completely enclosed by a cover 28 that can be made from any suitable material, but preferably from a washable fabric or from a water-resistant vinyl composition. Cover 28 includes a front face 30, a rear face 32, a first end 34, a second end 36, a lower surface 38 and an upper surface 40. Cover 28 includes a zipper 42 that continuously extends along substantially the entire length of the midline of cover second end 36, along the entire length of the midline of cover rear face 32 and along less than one half of the length of the midline of cover first end 34. Zipper 42 can be opened in order to receive block 12 within cover 28. While a zipper is utilized in the first preferred embodiment of the present invention, one of ordinary skill in the art will recognize that any closure, such as studs or clips, can be utilized.

Cover 28 also includes a pouch 44 having a lower portion 46, an upper portion 48 and a retainer 50. Lower portion 46 includes a rear end 52 and a front end 54 [not shown] and is conformable to the shape of groove 26. Upper portion 48 of pouch 44 begins forward of rear end 52 of lower portion 46 and forms the enclosed, upper aspect of pouch 44. An opening 56 is thus defined between lower portion rear end 52 and the edge of upper portion 48 closest to lower portion rear end 52. Upper portion 48 is of a generally elongate, tubular shape and tapers towards cover front face 30 to form an adjustable, annular opening 58. Retainer 50 extends across the proximal portion of groove 26 that opens onto block front face 14 and is attached to upper portion 48 of pouch 44. Retainer 50 restricts the forward motion of a bottle housed within pouch 44.

Cover 28 and pouch 44 can be of unitary construction, or pouch 44 can be separately constructed and incorporated, for example by stitching, into cover 28. Since most of the milk, or other liquid nutrient, spilled by the feeding infant is likely to contact and accumulate within pouch 44, pouch 44 is preferably constructed from a water-resistant material, such as a water-resistant vinyl composition. One of ordinary skill in the art will recognize, however, that pouch 44 can be made from any art-recognized, water-resistant material such as, but not limited to, suede.

Additionally, cover 28 includes a pouch strap 60 having a first end 62 and a second end 64. Pouch strap first end 62 is fixedly attached, for example by stitching, to cover upper surface 40 immediately adjacent to the side of pouch 44 closest to cover first end 34. Pouch strap 60 is composed of a first layer 66 and a second layer 68. First layer 66 is constructed from the hook-bearing component of a hook-and-loop fastener material, such as Velcro, and includes hooks mounted on a backing material. Second layer 68 of pouch strap 60 is constructed from the loop-bearing component of a hook-and-loop fastener material, such as Velcro, and includes loops mounted on a backing material. First layer 66 and second layer 68 are stitched together along their respective lengths with the hooked surface of first layer 66 in face-to-face contact with the backing material of second layer 68. First layer 66 is longer than second layer 68, thus pouch strap second end 64 is formed from the portion of first layer 66 that extends beyond pouch strap second layer 68.

Cover 28 also includes a loop 70 secured, for example by stitching, to the portion of cover upper surface 40 that is adjacent pouch 44 and is directly opposite pouch strap first end 62.

Cover 28 can be in the shape of any animate object, but preferably an animal, and most preferably a cow. As shown in the figures, especially FIG. 2, the body of the cow is formed from the portion of cover 28 enclosing block 12, while legs 86, 88, 90 and 92 are attached, for example by stitching, to the four corners of cover front face 30 and project away from front face 30. Legs 86, 88, 90 and 92 are preferably covered with the same material as the body of cover 28, and are stuffed with foam or some other soft material. Pouch 44, including a bottle 93 inserted therein, represents the udder of the cow. The first preferred embodiment of baby bottle holder 10 includes a head 94 which, like legs 86, 88, 90 and 92, is preferably covered with the same material as the body of cover 28, and is stuffed with foam or some other soft material. In the first preferred embodiment shown in FIGS. 1–3, especially FIG. 3, head 94 is removably attached to cover 28 at the corner of cover upper surface 40 adjacent to the intersection of cover first end 34, cover rear face 32 and cover upper surface 40. Head 94 is removably attached to cover 28 by means of a hook-and-loop fastener such as Velcro strips 95 shown in FIG. 3, although any closure known to one skilled in the art can be utilized. Also, while Velcro strips 95, shown in the figures, are oriented parallel to the intersection of cover front face 30 and cover upper surface 40, it will be readily apparent to one of ordinary skill in the art that Velcro strips 95 can have any one of numerous orientations on cover upper surface 40. By way of non-limiting example, Velcro strips 95 can be oriented diagonally on cover upper surface 40. Alternatively, head 94 can be fixedly attached to cover 28, for example by stitching. One skilled in the art will readily appreciate that numerous, minor modifications can be made to the cover that fall within the scope of the invention. For example, toys may be attached to one or more of legs 86, 88, 90 and 92, and cover 28 can include surface indicia having a wide variety of colors and patterns.

Although cover 28 of baby bottle holder 10 is preferably in the shape of an animate object, most preferably in the shape of a cow, cover 28 is not necessarily formed in the shape of an animate object. For example, cover 28 may simply conform to the shape of block 12. Additionally, toys or other figures can be attached to cover 28. When the attached figure is a figure of an animate object, such as a teddy bear, the figure may be fixedly attached, for example in a sitting position, to upper surface 40 of cover 28, thereby generating the appearance that the seated figure is feeding the infant. The appearance that the seated figure is feeding the infant can be enhanced by attaching at least one arm of the sitting figure to cover upper surface 40 close to pouch 44.

Baby bottle holder 10 of the present invention preferably includes an inflatable bladder 72 for raising or lowering the height of baby bottle holder 10. Thus, as shown in the figures, especially FIG. 3, inflatable bladder 72 can be fixedly attached, for example by stitching, to the entire outer aspect of cover lower surface 38. If it is desired to increase the height of baby bottle holder 10, air can be blown into bladder 72 through inlet 74 which can be fitted with a removable cap 76 to prevent the escape of air from bladder 72. The height of baby bottle holder 10 can thus be increased or decreased by a desired amount by completely, or partially, inflating or deflating bladder 72. It is understood that, while bladder 72 is shown attached to the outer aspect of cover lower surface 38 in the first preferred embodiment shown in FIGS. 1–3, bladder 72 may also be attached to block lower surface 22. If attached to the outer aspect of cover lower surface 38, bladder 72 is preferably constructed from a washable material such as vinyl.

With reference again to FIGS. 1–3, especially FIG. 2, baby bottle holder 10 additionally includes a strap 78 fixedly attached, for example by stitching, along the length of the midline of the lower surface 79 of bladder 72. A first end 80 of strap 78 extends beyond cover first end 34, and a second end 82 of strap 78 extends beyond cover second end 36. A male mating fitting 84 and a female mating fitting 85 are slidably mounted on strap first end 80 and strap second end 82, respectively.

The operation of the first preferred embodiment of baby bottle holder 10 of the present invention is now described in detail. As shown in FIG. 3, first preferred embodiment of baby bottle holder 10 is assembled by inserting block 12 into cover 28 through the opening in cover rear face 32 created when zipper 42 is unzipped. Block 12 is secured within cover 28 by closing zipper 42. A baby bottle 93, bearing a nipple 96 at one end, is inserted, nipple first, into opening 56 of pouch 44 so that nipple 96 protrudes through annular opening 58, as more clearly shown in FIG. 2. Bottle 93 is retained within pouch 44, which, in turn, is housed within groove 26, in part by the compressive resilience of the foam material used to construct block 12.

In operation, pouch strap 60 is looped across pouch 44, containing baby bottle 93, and pouch strap second end 64 is inserted into loop 70. Pouch strap 60 is drawn through loop 70 thereby tightening pouch strap 60 against baby bottle 93, by a desired amount. Pouch strap 60 is folded back towards pouch strap first end 62 so that the portion of pouch strap first layer 66 that extends beyond pouch strap second layer 68, and forms pouch strap second end 64, is brought into face-to-face contact with pouch strap second layer 68. The hooks on pouch strap second end 64 thus securely engage the loops on pouch strap second layer 68, thereby firmly positioning pouch strap 60 across pouch upper portion 48.

Both the depth and angle of baby bottle 93 within groove 26 are adjusted by pushing downwards on baby bottle 93. Thus, for example, by pushing down on the end of baby bottle 93 distal to nipple 96, nipple 96 is raised relative to the face of an infant seated facing block first face 14. Conversely, application of a downward force on the end of baby bottle 93 bearing nipple 96 causes nipple 96 to be lowered relative to the face of an infant seated facing block front face 14. Adjustment of the height and angle of baby bottle 93 within pouch 44 is facilitated by constructing block 12 from a soft, resilient, compressible material, such as a soft, flexible polyurethane or polyethylene blend.

Baby bottle holder 10 of the first preferred embodiment of the present invention is designed to be attached to one or more horizontal members of any structure that supports an infant, or to a horizontal structure located close to an infant. In particular, baby bottle holder 10 of the present invention can be attached to an infant's car seat, or to the horizontal table member of an infant's high chair. FIG. 1 shows the first preferred embodiment of baby bottle holder 10 of the present invention attached to a baby's high chair 98. Assembled baby bottle holder 10 is supported by baby's high chair 98 with cover lower surface 38, and block lower surface 22, resting on high chair horizontal table member 100. Strap first end 80 and strap second end 82 each extend under high chair horizontal table member 100 and are connected thereunder by means of male mating fitting 84 and female mating fitting 85. Once strap first end 80 and strap second end 82 are connected, strap 78 can be tightened around high chair horizontal table member 100 by sliding either one or both of male mating fitting 84 and female mating fitting 85 along strap first end 80 and strap second end 82, respectively.

The height of baby bottle 93 relative to the feeding infant's face can be altered by pushing down on the baby bottle to increase the depth to which baby bottle 93 penetrates groove 26, and/or by inflating or deflating bladder 72. Thus, for example, blowing air into bladder 72 increases the height of baby bottle holder 10 and, hence, increases the height of baby bottle 93 relative to a seated infant's face.

Figure 4:
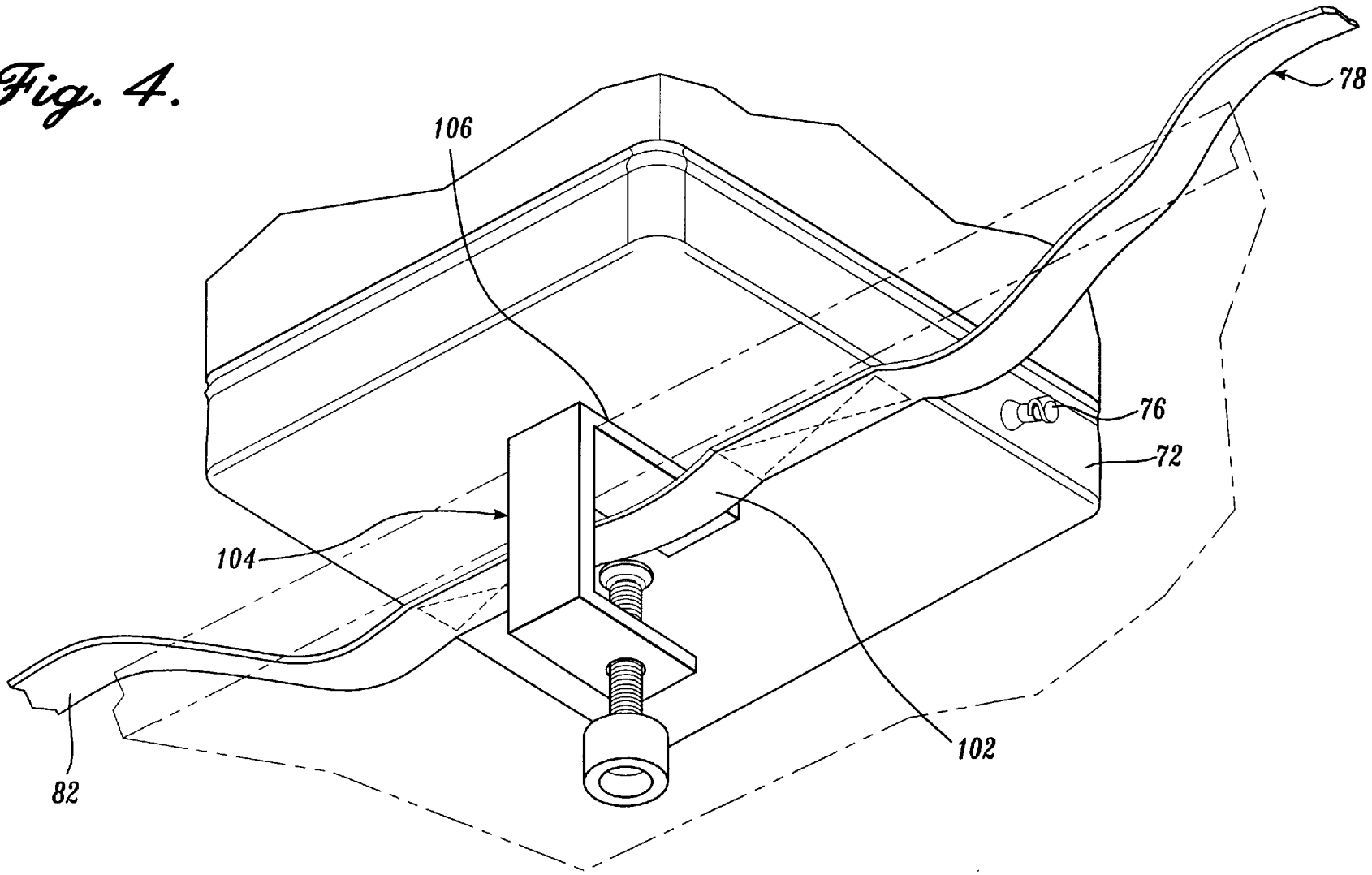
FIG. 4 is a view of the lower surface of the second preferred embodiment of the baby bottle holder of the present invention.

FIG. 4 shows the lower surface of a second preferred embodiment of baby bottle holder 10 which is identical to the first preferred embodiment of baby bottle holder 10, except that a portion of strap 78 forms a loop 102 in strap 78 that is centrally-located on lower surface 79 of bladder 72. As shown in FIG. 4, loop 102 receives a C-clamp 104 which can be used to secure baby bottle holder 10 to a horizontal surface, such as the horizontal surface of a table. Preferably the upper portion 106 of C-clamp 104 is flattened so that it does not protrude upwards to an extent sufficient to prevent lower surface 22 of foam block 12 from stably resting on a horizontal support member, such as the horizontal surface of a table.

The second preferred embodiment of baby bottle holder 10 of the present invention is adapted for use, for example, where the feeding child is seated within a high chair that does not include a horizontal table member, and strap 78 is not long enough to wrap around an available horizontal support surface. In this situation, C-clamp 104 secures baby bottle holder 10 to a horizontal support surface, such as the horizontal surface of a table, and the high chair is located sufficiently close to the horizontal member supporting baby bottle holder 10 that the seated child can feed from the bottle retained within baby bottle holder 10. While the second preferred embodiment of the present invention utilizes a C-clamp, as shown in FIG. 4, to attach baby bottle holder 10 to a horizontal support structure, one of ordinary skill in the art will readily appreciate that other types of clamps can be utilized in place of a C-clamp. For example, a C-shaped spring clamp can be utilized whereby the tension generated when the two ends of the C-shaped spring clamp are forced apart causes the two ends to grip a horizontal support member inserted therebetween.

While the preferred embodiments of the invention have been illustrated and described, it will be appreciated that various changes can be made therein without departing from the spirit and scope of the invention.

What is claimed is:

1. A baby bottle holder adapted for attachment to a horizontal support member in the vicinity of a feeding infant, comprising:

a bottle support, said bottle support comprising a light-weight block comprising an upper surface, a lower surface, a front face, a rear face, a first end and a second end, said upper surface sloping downwards from said rear face to said front face so that, when viewed from either said first end or from said second end, said light-weight block has a trapezoidal cross-section;

a groove defined by said light-weight block, said groove opening onto a central portion of said upper surface and an upper, central portion of said front face, said groove sloping downwards towards said front face and being adapted to retain a baby bottle at a downward angle relative to a horizontal plane thereby facilitating the flow of liquid nutrient out of the baby bottle;

a cover enclosing said bottle support, said cover being in the form of animate object and comprising a member in the form of an animal head, said head member being attached to a portion of said cover distal to said groove; and a strap attached to at least a portion of said cover for securing said bottle holder to a horizontal support member.

2. The baby bottle holder of claim 1 wherein said groove is oriented at an angle of approximately 45 degrees relative to a horizontal plane.

3. The baby bottle holder of claim 1 wherein said cover further comprises a pouch conformable to the shape of said groove, said pouch comprising an upper aspect, a retainer forming a proximal portion of said pouch for limiting the forward motion of a baby bottle disposed within said pouch, and an adjustable strap extending across the upper aspect of said pouch.

4. The baby bottle holder of claim 1 wherein the cover is removable.

5. The baby bottle holder of claim 1 wherein the cover is washable.

6. The baby bottle holder of claim 1 wherein the cover is in the form of a cow.

7. The baby bottle holder of claim 1 wherein a portion of said strap forms a loop, said loop receiving a clamp for securely attaching said baby bottle holder to a horizontal support.

8. The baby bottle holder of claim 1 wherein a portion of said strap forms a loop, said loop receiving a clamp for securely attaching said baby bottle holder to a horizontal support.

9. A baby bottle holder adapted for attachment to a horizontal support member in the vicinity of a feeding infant, comprising:

a bottle support, said bottle support comprising a light-weight block comprising an upper surface, a lower surface, a front surface, a rear face, a first end and a second end, said upper surface sloping downwards from said rear face to said front face so that, when viewed from either said first end or from said second end, said light-weight block has a trapezoidal cross-section;

a groove defined by said light-weight block, said groove opening onto a central portion of said upper surface and an upper, central portion of said front face, said groove sloping downwards towards said front face and being adapted to retain a baby bottle at a downward angle relative to a horizontal plane thereby facilitating the flow of liquid nutrient out of the baby bottle;

a cover enclosing said bottle support, said cover being in the form of an animate object and comprising a member in the form of an animal head, said head member being attached to a portion of said cover distal to said groove;

an inflatable bladder attached to at least a portion of a lower surface of said cover; and a strap attached to at least a portion of said bladder for securing said bottle holder to a horizontal support member.

* * * * *